US006145496A

United States Patent [19]

Pace et al.

[11] Patent Number: 6,145,496

[45] Date of Patent: Nov. 14, 2000

[54] FUEL INJECTOR WITH POROUS ELEMENT FOR ATOMIZING FUEL UNDER AIR PRESSURE

[75] Inventors: Jeffrey B. Pace, Newport News; Vernon R. Warner, Wicomico, both of Va.

[73] Assignee: Siemens Automotive Corporation, Auburn Hills, Mich.

[21] Appl. No.: 09/056,290

[22] Filed: Apr. 7, 1998

[51] Int. Cl.[7] ..... F02M 69/08

[52] U.S. Cl. ..... 123/531; 239/533.14

[58] Field of Search ..... 123/590, 593, 123/531, 533, 585; 239/533.3, 533.12, 533.14

[56] References Cited

U.S. PATENT DOCUMENTS

| | | | |
|---|---|---|---|
| 4,159,703 | 7/1979 | Mayer | 123/531 |
| 4,325,341 | 4/1982 | Yamauchi et al. . | |
| 4,344,459 | 8/1982 | Nelson | 239/533.14 |
| 4,796,816 | 1/1989 | Khinchuk | 239/533.12 |
| 5,129,381 | 7/1992 | Nakajima | 123/531 |
| 5,170,766 | 12/1992 | Haas et al. | 123/531 |
| 5,220,900 | 6/1993 | Wakeman | 123/590 |
| 5,241,938 | 9/1993 | Takagi et al. . | |
| 5,271,358 | 12/1993 | Katoh et al. | 123/593 |
| 5,323,753 | 6/1994 | Cikanek, Jr. et al. . | |
| 5,355,858 | 10/1994 | Kiyomura et al. . | |
| 5,437,258 | 8/1995 | Williams et al. | 123/593 |
| 5,437,413 | 8/1995 | Shen et al. . | |
| 5,503,130 | 4/1996 | Pomeisl | 123/533 |

FOREIGN PATENT DOCUMENTS

| | | |
|---|---|---|
| DE 2416804 | 10/1975 | Germany . |
| WO 9309344 | 12/1992 | WIPO . |

*Primary Examiner*—Erick R. Solis

[57] ABSTRACT

A fuel injector has a shroud surrounding its valve orifice. The shroud carries a porous element spaced from the orifice to define a chamber. Air passages are provided through the shroud for injecting air under pressure into the chamber. The fuel sprayed onto the porous element from the orifice enters the pores of the element and increases the wetted surface area such that the air under pressure passing through the porous element shreds the fuel films and finely atomizes the fuel for egress from the porous element into the internal combustion engine.

12 Claims, 2 Drawing Sheets

FUEL INJECTOR WITH POROUS ELEMENT FOR ATOMIZING FUEL UNDER AIR PRESSURE

TECHNICAL FIELD

The present invention relates generally to fuel injectors for injecting liquid fuel for combustion into an internal combustion engine and particularly relates to a fuel injector having a porous element downstream of the nozzle for receiving fuel and an air passage for flowing fuel under pressure through the porous element for finely atomizing the fuel.

BACKGROUND

As well known, fuel injectors for injecting fuel into internal combustion engines typically include an armature assembly for axially reciprocating a needle within the interior of the fuel injector body in response to electrical energization and deenergization of an electromechanical actuator to selectively open and close a fuel flow passage through the tip of the fuel injector. The needle of the armature assembly typically reciprocates in relation to a valve seat between a valve-open position for flowing fuel through an orifice at the injector tip and a valve-closed position with the tip of the needle engaging the valve seat. A nozzle is typically provided about the orifice for providing a conical or a swirling conical spray pattern of atomized fuel. Enhanced atomization of the fuel exiting the nozzle is, however, always an objective when designing a fuel injector.

DISCLOSURE OF THE INVENTION

In accordance with the present invention, an improved, finely atomized air/fuel mixture is provided by utilizing a porous element, downstream from the nozzle of the injector, as a mixing chamber to intermingle the fuel with an air source, hence generating a finely-atomized spray. The swirl or solid cone spray pattern of the injector nozzle is used to uniformly deposit the fuel onto the porous element. The porous element is an open-cell type and may be formed of a sintered metal, a foam porous plastic or a ceramic construction. Air under pressure is also introduced through a shroud surrounding the nozzle into the chamber between the nozzle and the porous element. When the fuel passes through the porous element and the air flow at high speed through the porous element, the air jets shred the liquid film in the interstices of the porous element, causing fine droplet atomization. That is, the porous element provides increased wetted surface area for the fuel film to interact with the air jets passing through the porous element. The result is a very finely atomized air/fuel mixture exiting the porous element. Preferably, a lower orifice disk is provided on the downstream side of the porous element to target and meter the air/fuel mixture through the porous element.

It will be appreciated that the porous element causes a restriction in the air flow depending on the average pore size and thickness and area of the porous element. Thus, the pressure at the injector liquid orifice disk exit will be at an elevated pressure and the liquid orifice disk hole diameter and the injector operating pressure can be sized for these conditions. The high speed air jet also makes up for the fuel transport lag caused by the interposition of the porous element between the conical or swirl spray of the injector nozzle and the internal combustion engine.

In a further form of the present invention, the porous element can be a layered structure. Thus, a first layer having a large pore size is disposed to receive the fuel spray pattern from the nozzle. This large pore size provides for coarse liquid fuel/air jet interaction and a small pressure drop. A second layer on the side of the first layer opposite from the nozzle has a smaller pore size for fine mixing and affords a larger pressure drop. It will be appreciated that the various combinations of pore sizes and thickness ratios can be provided and optimized for maximum mixing efficiency and minimal pressure losses across the porous element. The porous element, whether one layer or two layers, can be bounded by solid material whereby the diameter of the porous element(s) through which the liquid and air passes can be matched with a lower orifice disk to prevent "dead zones" in the shroud surrounding the injector nozzle.

In a preferred embodiment according to the present invention, there is provided a fuel injector for an internal combustion engine, comprising an injector body having a seat, an orifice through the seat and an injector needle reciprocable along an axis between a first position having a tip thereof spaced from the valve seat defining a passage for flowing fuel between the needle and the seat and through the orifice and a second position with the tip engaging the seat and closing the fuel passage, a shroud defining a chamber downstream of the orifice for receiving the fuel flowing through the orifice and carrying a porous element spaced from the orifice and on an opposite side of the chamber from the orifice for receiving fuel flowing through the orifice and the chamber, an air passage for flowing air under pressure into the chamber for flow through the porous element, thereby atomizing the fuel in the porous element and an outlet on the side of the porous element opposite the chamber for flowing the atomized fuel from the injector.

In a further preferred embodiment according to the present invention, there is provided a fuel injector having an orifice for periodically injecting fuel into an internal combustion engine, comprising a porous element carried by the injector and spaced downstream from the nozzle for receiving fuel flowing through the orifice and an air passage carried by the injector for directing air under pressure onto and through the porous element for causing fine droplet atomization of the fuel in the interstices of the porous element.

Accordingly, it is a primary object of the present invention to provide a novel and improved injector having enhanced fuel/air atomization by employing a porous element downstream of the injector nozzle and air under pressure to increase the wetted surface area and afford fine atomization.

BEST MODE FOR CARRYING OUT THE INVENTION

Figure 1:
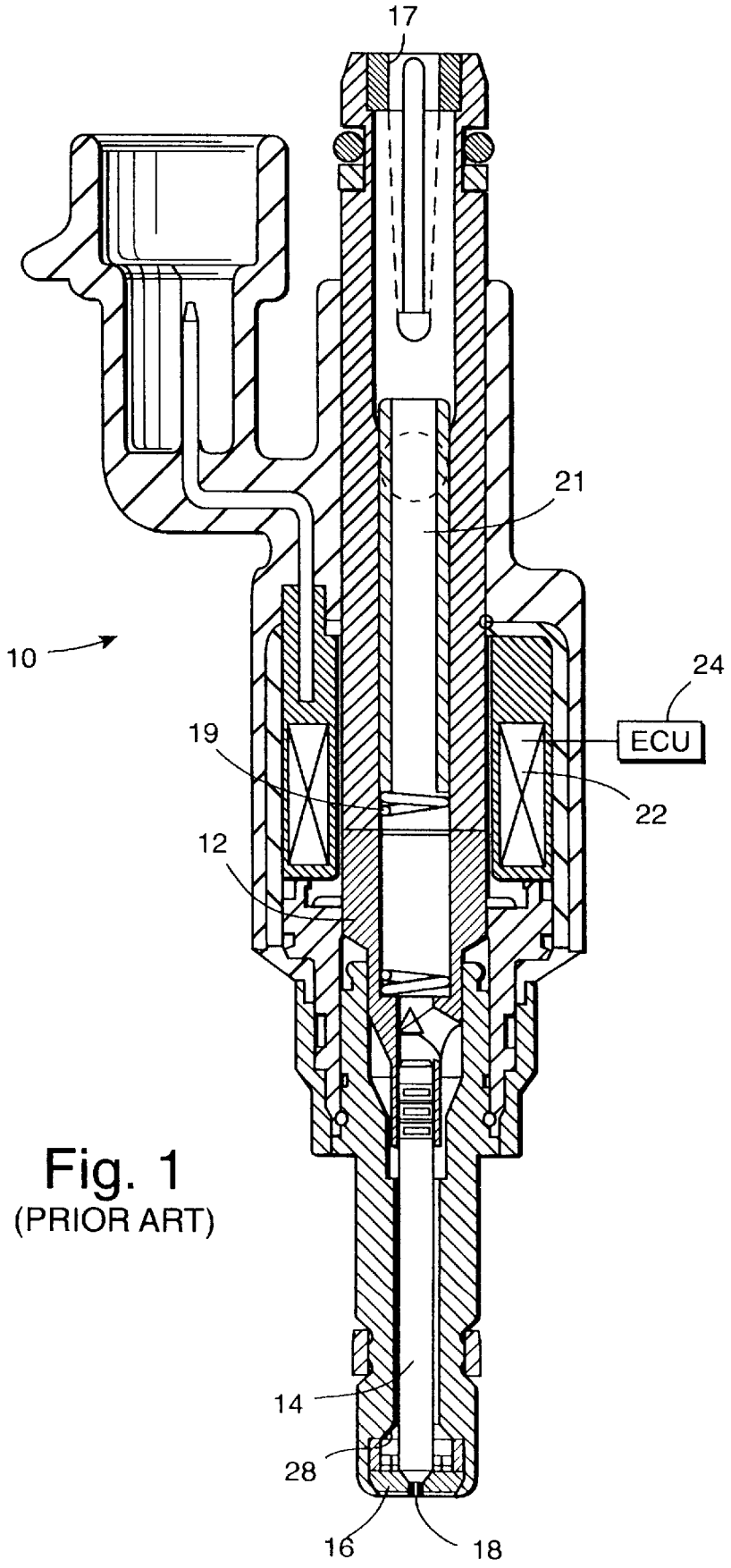
Fig. 1 (PRIOR ART)
FIG. 1 is a cross-sectional view of a conventional fuel injector.

Referring now to FIG. 1, there is illustrated a fuel injector, generally designated 10, including a reciprocating armature assembly 12 supporting an injector needle 14. The armature assembly 12 is reciprocable to displace the needle 14 along its axis between open and closed positions relative to the valve seat 16. That is, the injector needle tip, when spaced from the valve or needle seat 16, enables fuel to flow through an orifice 18 in valve seat 16 and when engaging the valve or needle seat 16, prevents flow of fuel through the orifice 18. The armature assembly 12 includes a spring 19 which urges the needle 14 toward the valve-closed position. An electromagnetic coil 22 receives pulsed electrical signals, which cause the armature assembly 12 and needle 14 to be periodically displaced against the bias of spring 19, thereby to periodically displace the needle between the valve-open and valve-closed positions. A driver circuit 24 of an ECU applies the signal to the electromagnetic coil 22. Fuel is supplied to a fuel injector inlet 17 for flow through a central axial passageway 21 to armature 12 about needle 14 for egress through the orifice 18 in the valve-open position in a conical spray pattern. If desired, a swirl disk may be provided to provide a swirling conical spray pattern through orifice 18.

Figure 2:
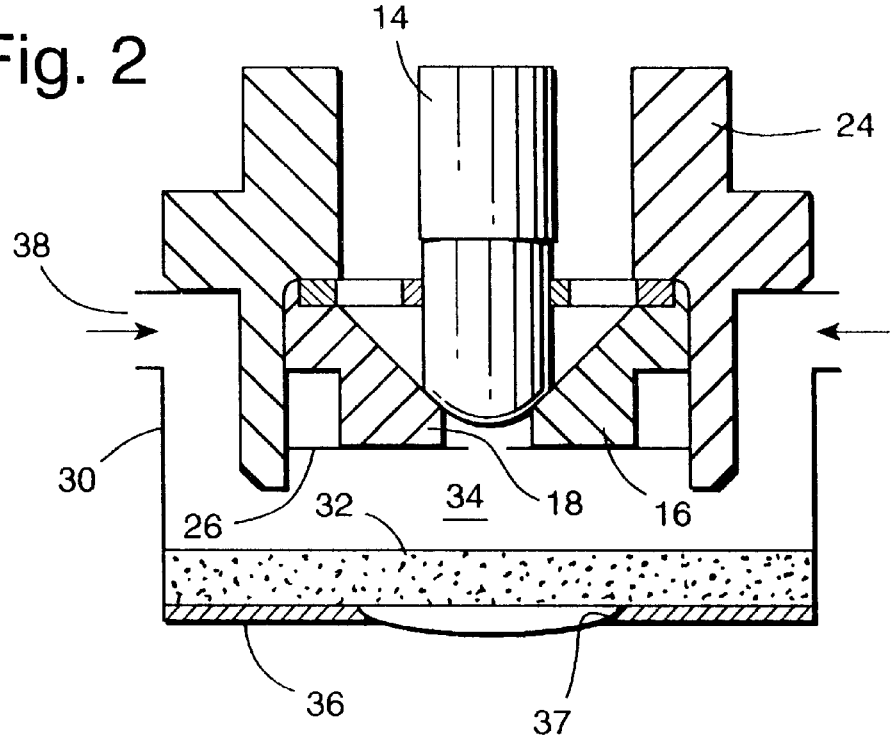
FIG. 2 is an enlarged fragmentary cross-sectional view of an end portion of a fuel injector constructed in accordance with the present invention illustrating the enhanced atomizer elements.

Referring now to FIG. 2, there is illustrated an end portion of an injector constructed in accordance with the present invention and which end portion includes, as in the prior art of FIG. 1, a portion of the injector body 24, the needle 14, the valve or needle seat 16, and valve orifice 18. A nozzle plate 26 is carried by the body 24 below the orifice 18 to provide a swirl or solid cone pattern of fuel when the valve is opened. In accordance with the present invention, there is provided a shroud 30, suitably secured to the valve body 24 and surrounding the orifice 18. The shroud 30 thus depends from the valve body 24. At the lower end of the shroud body 30, there is provided a porous element 32 spaced from the orifice 18 and nozzle plate 26 to define a chamber 34 between element 32 and nozzle plate 26. Downstream or below the porous element 32, there is provided a lower orifice disk 36 having a central opening 37 through which finely atomized fuel/air passes en route to the induction manifold or combustion chamber of an internal combustion engine. One or more air passages 38 are provided through the side wall of the shroud 30 to supply air under pressure to the chamber 34 and for flow through the porous element and the opening of the orifice disk 36.

The porous element 32 may be a sintered metal construction, a foamed porous plastic or a ceramic construction. The porous element is, of course, open-cell. The pore size may, for example, approximately 100 :m. It will be appreciated that the pore size, as well as the thickness and area of the porous element 32 can be varied for any specific application.

As illustrated, when the needle 14 moves to a valve-open position, fuel is sprayed in a swirl or solid cone pattern into the chamber 34 before impact on the porous element 32. The fuel then passes into and through the interstices of the porous element 32. Simultaneously, the air under pressure provided chamber 34 by passages 38 also passes through the porous element 32 at a relatively high speed. The air jets passing through the porous element shred the liquid films formed in the pore cavities, causing fine droplet atomization. The porous element 32 with its numerous pores provides increased wetted surface area for the liquid film of fuel to interact with the air jets under pressure. As a result, a very finely atomized air/fuel mixture is provided for egress through the central opening 37 of the orifice disk plate 36. The orifice disk plate 36 can be configured to target the fuel/air mixture egressing the injector. Also, it will be appreciated that the porous element 32 causes a restriction in the air flow depending upon the average pore size and the thickness and area of the porous disk. Thus, the pressure at the injector liquid orifice disk exit will be elevated and the liquid orifice disk hole diameter and the injector operating pressure are sized for those conditions.

Figure 3:
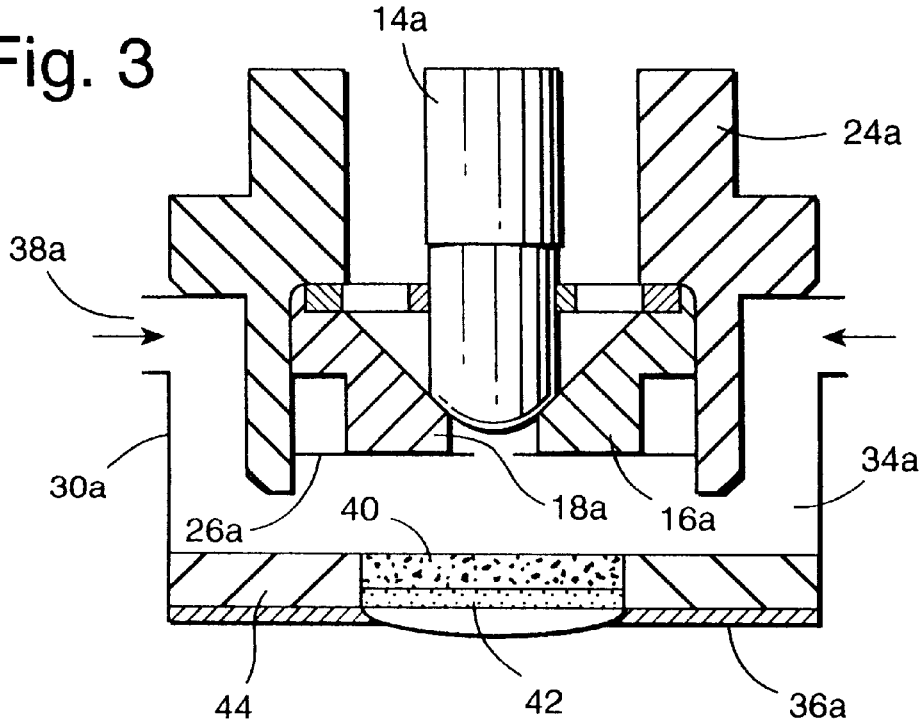
FIG. 3 is a view similar to FIG. 2 illustrating a further form of the invention.

Turning to FIG. 3, wherein like reference numerals apply to like parts, followed by the suffix "a," the shroud 30*a* may carry a layered structure of porous elements. Hence, a first layer comprising a porous element 40 may overlie a second layer comprising a second porous element 42. The first porous layer 40 upstream of the second porous layer 42 may comprise a thicker porous layer having a large pore size for coarse liquid fuel/air jet interaction and a small pressure drop. The second porous layer 42 may have a smaller pore size with a larger pressure drop for fine mixing of the fuel/air.

As illustrated, the layered porous disk of this embodiment, as well as the porous element 32 of the first embodiment may be surrounded by a solid collar 44 to prevent "dead zones" within the chamber 34*a* and fuel collecting in the pores which would not otherwise be passed through the pores and the orifice exit opening. Also, the lower orifice disk 36*a* is sized preferably such that its opening registers with the layered porous elements 40 and 42 and underlies the collar 44. The operation of this type of injector is similar as described above with respect to the injector and porous element of the first embodiment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel injector for an internal combustion engine, comprising:

an injector body having a seat, an orifice through said seat and an injector needle reciprocable along an axis between a first position having a tip thereof spaced from the valve seat defining a passage for flowing fuel between said needle and said seat and through said orifice and a second position with the tip engaging said seat and closing said fuel passage;

a shroud defining a chamber downstream of said orifice for receiving the fuel flowing through said orifice and carrying a porous element spaced from said orifice and on an opposite side of said chamber from said orifice for receiving fuel flowing through said orifice and said chamber;

an air passage for flowing air under pressure into said chamber for flow through said porous element, thereby atomizing the fuel in said porous element; and an outlet on the side of the porous element opposite the chamber for flowing the atomized fuel from the injector.

2. An injector according to claim 1 wherein said outlet comprises an orifice disk having an opening for directing atomized fuel from the injector.

3. An injector according to claim 1 wherein said orifice supplies a swirl or solid cone pattern of fuel into said chamber, said porous element lying in registration with said swirl or solid cone pattern of fuel and having an extent in a plane normal to said axis and an axial spacing from said orifice to receive substantially the entirety of the pattern of fuel flowing from the orifice.

4. An injector according to claim 1, wherein the porous element comprises at least one of sintered metal, foamed porous plastic, and ceramic.

5. A fuel injector for an internal combustion engine, comprising:

an injector body having a seat, an orifice through said seat and an injector needle reciprocable along an axis between a first position having a tip thereof spaced from the valve seat defining a passage for flowing fuel between said needle and said seat and through said orifice and a second position with the tip engaging said seat and closing said fuel passage;

a shroud defining a chamber downstream of said orifice for receiving the fuel flowing through said orifice and carrying a porous element spaced from said orifice and on an opposite side of said chamber from said orifice for receiving fuel flowing through said orifice and said chamber;

an air passage for flowing air under pressure into said chamber for flow through said porous element, thereby atomizing the fuel in said porous element; and an outlet on the side of the porous element opposite the chamber for flowing the atomized fuel from the injector;

wherein the porous element has first and second layers, with the first layer between said second layer and said chamber and having a pore size larger than a pore size of said second layer, whereby the first layer provides a coarse fuel/air mixing interaction and the second layer provides a fine fuel/air mixing interaction.

6. An injector according to claim 5 wherein said outlet comprises an orifice disk having an opening for directing atomized fuel from the injector, said porous element and said disk opening lying in registration with one another.

7. An injector according to claim 6 wherein said shroud has a non-porous portion surrounding the porous element.

8. A fuel injector having an orifice for periodically injecting fuel into an internal combustion engine, comprising:

a porous element carried by the injector and spaced downstream from an orifice of a valve nozzle, the porous element receiving the fuel flowing through the orifice;

an air passage carried by the injector for directing air under pressure onto and through said porous element for causing fine droplet atomization of the fuel in the interstices of the porous element; and a lower orifice disk placed on the side of the porous element remote from the orifice of the valve nozzle and having an opening for directing the fuel/air mixture flowing through the porous element.

9. An injector according to claim 8 including a nozzle plate having an opening for flowing atomized fuel from the injector orifice onto said porous element, said porous element and said orifice disk opening lying in registration with one another.

10. An injector according to claim 8 wherein said injector orifice supplies a swirl or solid cone pattern of fuel into said chamber, said porous element lying in registration with said swirl or solid cone pattern of fuel and having an extent in a plane normal to said axis and an axial spacing from said orifice to receive substantially the entirety of the pattern of fuel flowing from the orifice.

11. An injector according to claim 8, wherein the porous element comprises at least one of sintered metal, foamed porous plastic, and ceramic.

12. A fuel injector having an orifice for periodically injecting fuel into an internal combustion engine, comprising:

a porous element carried by the injector and spaced downstream from an orifice of a valve nozzle, the porous element receiving the fuel flowing through the orifice; and an air passage carried by the injector for directing air under pressure onto and through said porous element for causing fine droplet atomization of the fuel in the interstices of the porous element;

wherein said porous element has first and second layers, with the first layer between said second layer and the orifice and having a pore size larger than a pore size of the second layer, whereby the first layer provides a course fuel/air mixing interaction and the second layer provides a fine fuel/air mixing interaction.

* * * * *